United States Patent [19]

Harris

[11] Patent Number: 4,627,120

[45] Date of Patent: Dec. 9, 1986

[54] BED FRAME ASSEMBLY

[75] Inventor: George M. Harris, Homewood, Ill.

[73] Assignee: Harris-Hub Company, Inc., Harvey, Ill.

[21] Appl. No.: 616,898

[22] Filed: Jun. 4, 1984

[51] Int. Cl.[4] ..... A47C 19/02

[52] U.S. Cl. ..... 5/201; 5/310

[58] Field of Search ..... 5/201, 202, 200, 282, 5/286, 310, 181

[56] References Cited

U.S. PATENT DOCUMENTS

| | | | |
|---|---|---|---|
| Re. 31,384 | 9/1983 | Mis | 5/310 |
| 2,825,073 | 3/1958 | Harris | 5/310 |
| 3,188,664 | 6/1965 | Goldberg | 5/282 R |
| 3,995,334 | 12/1976 | Harris | 5/181 |

*Primary Examiner*—Alexander Grosz

*Attorney, Agent, or Firm*—Dressler, Goldsmith, Shore, Sutker & Milnamow, Ltd.

[57] ABSTRACT

A bed frame having inset legs comprised of an inclined, inwardly extending upper portion and a vertical lower portion. The legs each include a first portion connected to an end of a cross-frame member and a second portion connected to a side-frame member. The first and second leg portions are telescopically associated to connect the side-frame and cross-frame members, and to support the resulting bed frame upon the floor.

8 Claims, 7 Drawing Figures

Fig. 5.
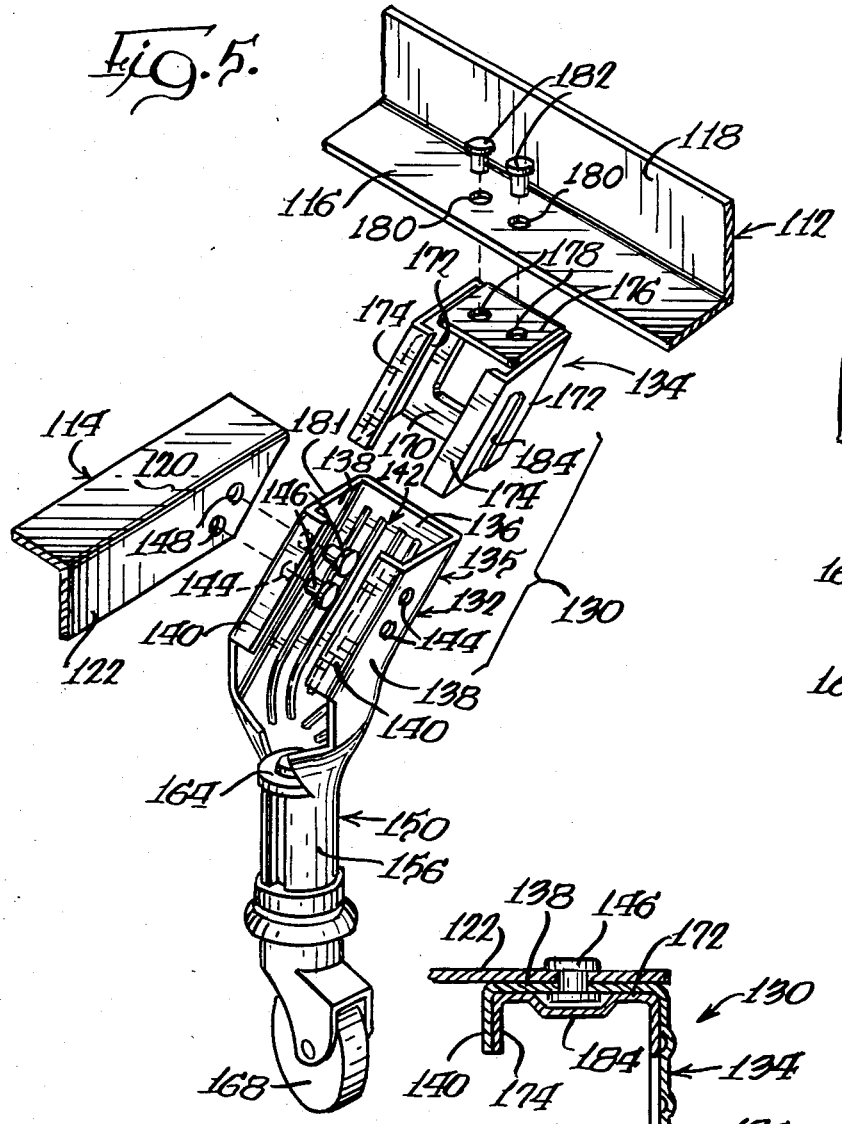
Fig. 6.
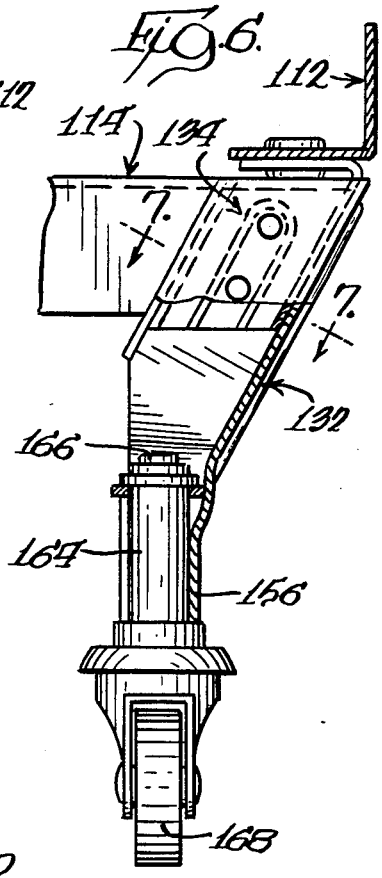
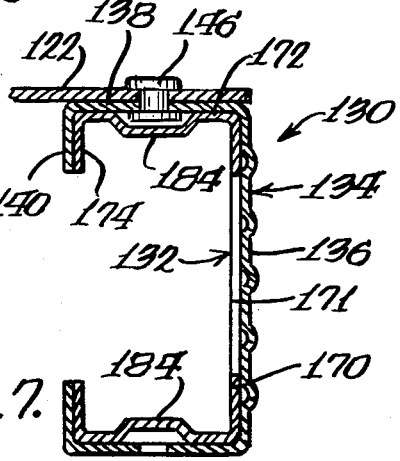
Fig. 7.

BED FRAME ASSEMBLY

BACKGROUND OF THE INVENTION

Knock-down bed frame assemblies of the so-called "Hollywood" type are well-known to those skilled in the art. Such structures have conventionally included pairs of generally L-shaped side and cross-frame members detachably secured to one another for supporting a mattress and box spring unit. Usually, these bed frame assemblies are supported by four leg assemblies that are respectively located at the four points of interconnection between the side-frame members and cross-frame members. In most of the bed frame assemblies presently available in the marketplace, the leg structures extend generally vertically with respect to the side frame members and are located directly below the side-frame members so that the caster wheels or other floor engaging members are located directly below the side-frame members.

It has been established by governmental agencies that many injuries in the home are associated with beds. Such injuries frequently result from adults and children striking their feet or toes against the legs or casters of the bed frame assembly. Solutions to this problem are addressed in U.S. Pat. Nos. 3,995,334 and Re. 31,384 assigned to the assignee of the present invention. The bed frames disclosed in those patents provide a leg structure which positions the floor engaging members, such as casters, a substantial distance inwardly of, and below the side frame members so that it is less likely that a person walking past the bed, using it or making it up, will make contact with the floor engaging members than if the legs were entirely vertical and directly under the side frame members at the floor level. However, the specific structures illustrated in those patents have certain drawbacks in terms of cost and use which the invention of the present application eliminates.

Among other things, the connecting structure of the those patents require either the use of expensive welding procedures to fabricate the unit or elaborately formed and assembled connecting mechanisms, or both. The present invention utilizes mechanical fasteners such as rivets or other like fasteners instead of expensive welding techniques. The present invention also utilizes easily formed metal connecting elements, such as those formed to provide easily produced, box-like rectilinear telescoping elements which are readily securable to the respective cross-frame members and side-frame members of the bed frame assembly. The telescoping elements produce a leg structure which is of substantial strength and which securely and stably supports a floor supporting means, such as a caster. Importantly, the supporting leg structure also serves to releasably secure the frame members to each other without other mechanisms or fasteners being required. The leg structures themselves have clean, aesthetic lines and give the appearance of relatively conventional legs.

Although the bed frames described in U.S. Pat. Nos. 3,995,334 and Re. 31,384 substantially diminish the likelihood of accidental injury to feet and toes, as stated the structures are relatively expensive and time consuming to fabricate and assemble. Accordingly, bed frame assemblies which would maintain the safety advantages of that patent, but which would be simpler and less expensive to make and assemble, would be of advantage and it is with such bed frame assemblies which the present invention relates.

Summary of the Invention

In accordance with the present invention, an improved bed frame is provided which comprises a pair of spaced longitudinally extending parallel side-frame members, each of said members having a horizontal leg portion, and a pair of spaced parallel cross-frame members extending between said side-frame members, each of the cross-frame members having a vertical leg portion. Means for securing the side-frame members to the ends of the cross-frame members and for supporting the frame on a floor comprising a plurality of first and second leg members, and floor engaging means are provided.

Pairs of first leg members are mechanically secured to each of the cross-frame members, and pairs of the second leg members are mechanically secured to each of the side-frame members and are telescopically disposed relative to the first leg members.

Each of the first leg members comprises an upper portion which is generally rectilinear in cross-section and which defines an upper end which is generally coplanar with the upper edge of the vertical leg portion.

The upper portion further comprises opposed spaced side walls, at least one of which side walls defines openings aligned with openings in the vertical leg portion of the cross-frame member for receiving mechanical fasteners. A side wall with openings is positioned to confront and bear against the vertical leg portion. The upper portion is inclined inwardly and downwardly at an acute angle of at least 20 degrees relative to the associated cross-frame member.

The first leg member further defines a lower portion which is vertically disposed and which is integrally formed with the upper portion, the lower portion being disposed to mount the floor engaging means and to support the bed frame on a floor.

Each second leg member is generally rectilinear in cross-section and has ear means positioned to confront and engage the horizontal leg portion of a side-frame member. The horizontal leg portion and the ear means each define aligned apertures for receiving mechanical fasteners. The second leg member is inclined inwardly and downwardly at an acute angle substantially equal to the angle at which the associated first leg member upper portion is inclined. When the first leg members are telescopically disposed relative to the associated second leg members, the side-frame and cross-frame members are secured to each other to form a bed frame and the lower portions of the leg members and associated floor engaging means are disposed inset of the side-frame members to protect toes and feet of a user.

The lower portion of said first leg member may be formed with an integral bottom section parallel to the floor and having a first aperture formed therein, and with an integral tab member extending inwardly above the bottom section and having a second vertically aligned aperture formed therein for receipt of the floor engaging means through the aligned apertures. The floor engaging means may comprise a bearing in the vertically aligned apertures and a caster having a stem seated in the bearing.

Preferably, the second leg member is slideably and telescopingly received entirely within the upper portion of an associated first leg member. The second leg member may define side wall members parallel with the side walls of the first leg member, and recess means in the side wall members extending upwardly from the lower edges thereof and in alignment with the mechanical fasteners in the cross-frame members.

In one form of the invention, the ear means may extend outwardly from the upper end of the second leg member and may comprise a pair of ears formed with and outwardly extending from said side-wall members.

In another form of the invention, the ear means may be formed integrally with the second leg member and may be disposed between the side-wall members and generally coplanar with the upper edges of the side-wall members to support the horizontal leg portion thereon. The first member lower portion may be a generally cylindrical housing oriented vertical to the floor and proportioned to receive the floor engaging means.

Each of the side walls of the upper portion may define openings for mechanical fasteners.

Further objects, features and advantages of the present invention will become apparent from the following description and drawings.

BRIEF DESCRIPTION OF THE DRAWINGS

FIG. 5 is an exploded view, similar to FIG. 2, of a further embodiment of the present invention;

FIG. 6 is a fragmentary side elevational view, partially in section, of a portion of FIG. 5; and FIG. 7 is a cross-sectional view taken generally along line 7—7 of FIG. 6.

DETAILED DESCRIPTION

Figures 1, 2, 3, 4:
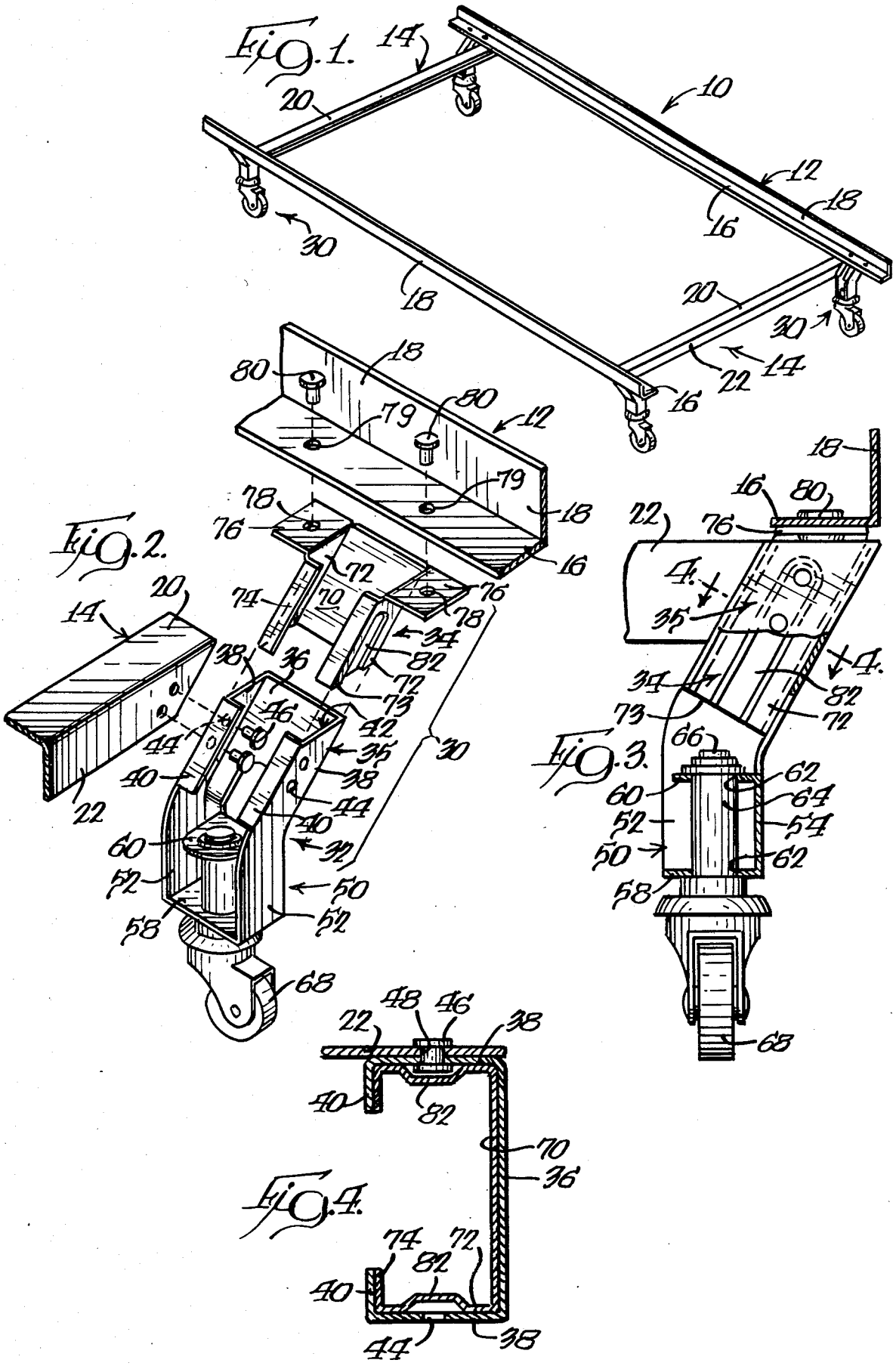
FIG. 1 is a perspective view of a bed frame incorporating the present invention.
FIG. 2 is an enlarged exploded view of a portion of the bed frame shown in FIG. 1.
FIG. 3 is a fragmentary side elevational view, partially in section, of a portion of the bed frame shown in FIG. 2.
FIG. 4 is a cross-sectional view taken generally along line 4—4 of FIG. 3.

While this invention is susceptible of embodiment in a variety of different forms, there is shown in the drawings and will herein be described in detail presently preferred embodiments of the invention, with the understanding that the present disclosure is to be considered as an exemplification of the principles of the present invention and is not intended to limit the invention to the embodiments illustrated. The scope of the invention will be pointed out in the appended claims.

Referring now to the drawings in detail, a bed frame assembly 10 is shown in FIG. 1 as comprising a pair of spaced parallel elongated side-frame members 12 spanned by a pair of spaced parallel cross-frame members 14 extending generally perpendicular with respect to the side-frame members 12. The cross-frame members may be of a conventional telescoping type.

Side-frame members 12 are elongated, generally L-shaped sheet metal or angle-iron members having horizontal inwardly facing coplanar leg portions 16 adapted to support a box spring and mattress on the upper surface thereof, and a generally vertically extending leg portion 18 adapted to confine the box spring and mattress on the coplanar leg portions 16.

Cross-frame members 14 are generally L-shaped sheet steel or angle-iron members with horizontal coplanar leg portions 20 and downwardly extending vertical leg portions 22. Cross-frame members 14 extend generally perpendicularly with respect to side-frame members 12, with horizontal coplanar portions 20 positioned immediately below the horizontal leg portions 16 of the frame members 12 when the frame is assembled.

Side frame members 12 are detachably secured to cross-frame members 14 by connecting means in a manner to be described below. The frame 10 is supported above the floor by two pairs of leg assemblies 30 which are positioned at the ends of the cross-frame members and which extend inwardly and downwardly at an angle with respect to the longitudinal extent of side-frame members 12. Each leg assembly 30 is formed of a telescoping first leg member 32 secured to cross-frame member 14 and a second leg member 34 secured to side-frame member 12.

First leg member 32 comprises an integrally formed sheet metal element defining an upper portion or section 35 of generally rectilinear cross-sectional configuration, including an open upper end 42, a back 36, two opposed, spaced side walls 38 formed with the back 36, and a pair of spaced coplanar front segments 40 each formed with a side wall 38. When viewed from the side, the side walls 38 have upper edges at the open upper end which are angled so that when the upper end is disposed horizontally, the back 36 extends downwardly and inwardly at an acute angle, such as at about at least 20 degrees, and preferably about 30 degrees, to a vertical plane which is parallel to vertical leg portion 18. The acute angle may be from about 20 degrees to about 60 degrees.

At least one of the side walls 38 is provided with a pair of spaced openings 44 through which suitable mechanical fasteners, such as rivets 46, are adapted to pass, thereby to secure a leg member 32 to the vertical leg 22 of a cross-frame member 14. As best seen in FIG. 2, the vertical leg 22 of cross-frame member 14 defines a pair of openings 48 adapted to be aligned with openings 44 so that rivets 46 may permanently secure first leg members 32 to cross-frame members 14. As such, a side wall 38 is positioned to confront and bear against a vertical leg 22. Other fasteners, such as nuts and bolts may be used as well to removeably secure each pair of leg members 32 to its cross-frame member 14. When the first leg member is secured to cross-frame member 14 and assembled with the side-frame members, it will be apparent that the upper end of upper portion 35 will be generally coplanar with the upper edge of the associated vertical leg portion 22.

Leg members 32 further include an integral lower support portion or section 50 which, in the embodiment of FIG. 1–4, is a vertically extending segment, angled at about 160 degrees to the upper section 35, i.e., at an angle supplementary to the above referred to 20 degree angle. Support section 50 comprises spaced, opposed side wall members such as sides 52, which may be coplanar with sides 38, a back 54 and support means at the lower end thereof. The support means comprises an integral bottom section 58 generally parallel to the floor, and an inwardly extending parallel bent over tab 60, which extends above the bottom section 58. Each defines a vertically aligned aperture 62 for receiving and frictionally retaining a caster, as via a caster bearing 64. The caster bearing 64 is disposed vertically when the bed frame assembly 10 is assembled and is adapted to suitably support and retain the stem 66 of a roller means or caster 68. As will be readily understood by those skilled in the art, other floor engaging means, such as a glide, may be substituted for the above describes caster.

As stated, the second leg member 34 is connected to side-frame member 12. Leg member 34 comprises a main body section which is generally rectilinear in horizontal cross-section, and comprises a back 70, a pair of sides 72 integrally formed with back 70, and a pair of front segments 74, each integrally formed with a side 72. Sides 72 are proportioned to lie generally parallel to sides 38 after assembly. Connecting ear means, such as a pair of coplanar ears 76, in this case formed with sides 72 and extending outwardly thereof, are provided for securance with a side-frame member 12, and in particular with the horizontal leg 16 thereof. To this end, ears 76 each define an aperture 78 alignable with spaced apertures 79 in the horizontal leg 16 through which suitable fasteners, such as rivets 80 or the like, may pass to secure the second leg member 34 to the side-frame member 12.

Leg member 34 is of a cross-sectional configuration which permits leg member 34 to be telescopically slideably received within the upper section 35 of leg member 32, thereby to releasably slideably secure the first and second leg members 32 and 34 to each other. As such, ears 76, when horizontal, are at an angle to the sides 72 which permits the sides and back to extend downwardly and inwardly at an acute angle of about 20 degrees (the same as does associated upper leg section 35) to a vertical plane parallel to side-frame member vertical legs 18.

To accommodate rivets 46, the sides 72 may define recess means such as slots or ribs 82 (see FIG. 4) which will align with and accept the heads of rivets 46. A rib 82 is provided on each side 72 (as are holes 44 on first frame member 32) so that the leg assemblies 30 may be secured at any of the four locations at which they are required, without requiring the formation of more than one of each of first and second leg members 32, 34. The recess means extend upwardly from the lower edges 73 of the sides 72.

As may be appreciated, a kit for a bed frame assembly in accordance with this invention may be produced by assembling each of two cross-frame members with a pair of first members 32 and each of two side-frame members with a pair of second leg members 34. The end user need only fit the second leg members into the first leg members to produce a frame for receiving a box spring and to produce a frame in which the legs (and associated casters or other support elements) are spaced and inset a substantial distance inwardly of the side-frame members, thereby to protect against injury to feet and toes.

Referring now to the embodiment of FIGS. 5–7, a bed frame assembly is shown to comprise a pair of spaced parallel elongated side-frame members 112 spanned by a pair of spaced parallel cross-frame members 114 extending generally perpendicularly with respect to the side-frame members 112. Cross-frame members 114 may be of the telescoping type.

Side frame members 112 are elongated, generally L-shaped sheet metal or angle-iron members having horizontal inwardly facing coplanar leg portions 116 adapted to support a box spring and mattress on the upper surface thereof, and a generally vertically extending leg portion 118 adapted to confine the box spring and mattress on the coplanar portions 116.

Cross-frame members 114 are generally L-shaped sheet steel or angle-iron members with horizontal coplanar portions 120 and downwardly extending vertical portions 122. Cross-frame members 114 extend generally perpendicular with respect to side-frame members 112 with horizontal coplanar leg portions 120 positioned immediately below the horizontal surface 116 of said frame members 112 when the frame is assembled.

Side-frame members 112 are detachably secured to cross-frame members 114 by connecting means to be described. The frame is supported above the floor by pairs of leg assemblies 130 which extend downwardly and inwardly at an angle with respect to the longitudinal extent of side frame members 112. Each leg assembly 130 is formed of a telescoping first leg member 132 secured to cross-frame member 114 and a second leg member 134 secured to side-frame member 112.

First leg member 132 comprises an integrally formed sheet metal element defining an upper portion or section 135 of generally rectilinear cross-sectional configuration, including an open upper end 142, a back 136, two opposed, spaced side walls 138 formed with the back 136, and a pair of spaced coplanar front segments 140 each formed with a side wall 138. When viewed from the side, the side walls 138 have upper edges 181 at the open upper end which are angled so that when tne upper end 142 is disposed horizontally, the back 136 extends downwardly and inwardly at an acute angle, such as at about 20 degrees to a vertical plane which is parallel to vertical leg portion 118.

One or both of the side walls 138 are provided with a pair of spaced holes 144 through which suitable fasteners, such as rivets 146, are adapted to pass to secure a leg member 132 to a cross-frame member 114. As best seen in FIG. 5, the vertical leg 122 of cross-frame member 114 defines a pair of holes 148 adapted to be aligned with holes 144 so that rivets 146 may permanently secure first leg members 132 to cross-frame members 114 with a side wall 138 confronting and bearing against a vertical leg 122. At that time, the upper edge 181 of upper end 142 of upper portion 135 will be generally coplanar with the upper edge of a vertical leg portion 122. Other fasteners, such as nuts and bolts may be used as well to removeably secure the cross-frame member to a pair of leg members 132.

Leg members 132 further include a support portion or section 150 which is a vertically extending segment, angled at about 160 degrees to the upper section 135. Support section 150 comprises a portion which merges into a generaly cylindrical bearing housing or section 156 for receiving and retaining a caster, as via a bearing 164. The caster bearing 164 is disposed vertically when the bed frame assembly is assembled and is adapted to suitably support and retain the stem 166 of a suitable caster 168.

The second leg member 134 is connected to side-frame member 112. Leg member 134 comprises a main body section whch is generally rectilinear in cross-section and comprises a back 170 defining a rectangular opening 171, a pair of sides 172 formed with back 170, and a pair of front segments 174, each integrally formed with a side 172. Sides 172 are proportioned to lie generally adjacent and parallel to sides 138 after assembly.

Connecting ear means, such as an ear 176, in this case formed with the back 170 and disposed between the sides 172 and generally coplanar with the upper edges of sides 172, is provided for securance with, and support of, a side-frame member 112, and in particular with the horizontal leg 116 thereof. To this end, ear 176 defines a pair of apertures 178 alignable with spaced apertures 180 in the horizontal leg 116 through which suitable fasteners, such as rivets 182 or the like, may pass to secure the second leg member 134 to the side-frame member 112. The upper edges of the sides 172 are preferably coplanar with the upper surface of the ear 176 thereby to provide additional support for the frame member 112.

Leg member 134 is of a cross-sectional configuration which permits leg member 134 to be telescopically slideably received within the upper section 135 of leg member 132, thereby to releasably slideably secure the first and second frame members 132 and 134 to each other. As such, ear 176, when horizontal, is at an angle to the sides 172 which permits the sides and back to extend downwardly and inwardly at an acute angle of about 20 degrees to a vertical plane parallel to side-frame member vertical legs 118.

To accommodate rivets 146, the sides 172 may define recess means such as slots or ribs 184 which will accept the heads of rivets 146. A rib 184 is provided on each side 172 (as are holes 144 on first member 132) so that the leg assemblies 130 may be secured at any of the four locations at which they are required, without requiring the formation of more than one of each of first and second leg members 132, 134.

As may be appreciated, a kit for a bed frame assembly in accordance with this embodiment may be produced by assembling each of two cross-frame members with a pair of first leg members 132 and each of two side-frame members with a pair of second leg members 134. The end user need only fit the second leg members into the first leg members to produce a frame for receiving a box spring and to produce a frame in which the legs (and associated casters or other support elements) are spaced and inset a substantial distance inwardly of the side-frame members, thereby to protect toes and feet against injury.

It is noted that the upper edges of sides 172 are positioned to help support side-frame members 112, as are upper side wall edges 142 and legs 120, thereby to provide a very solid and stable support structure.

What is claimed is:

1. A bed frame comprising a pair of spaced longitudinally extending parallel side-frame members, each said side-frame member having a horizontal leg portion, a pair of spaced parallel cross-frame members extending between said side-frame members, each said cross-frame member having a vertical leg portion defining fastener receiving openings, means for securing said side-frame members to the ends of said cross-frame members and for supporting said frame on a floor, said securing and supporting means comprising a plurality of first and second leg members, and floor engaging means, a pair of said second leg members being mechanically secured to each of said side-frame members and tdlescopically disposed relative to said first leg members, each said first leg member comprising an upper portion which is generally rectilinear in cross-section and which defines an upper end which is generally coplanar with the upper edge of said vertical leg portion of said cross-frame member, said upper portion comprising opposed spaced side walls, at least one of said side walls defining openings aligned with said openings in said cross-frame member vertical leg portion for receiving mechanical fasteners, said first leg member being positioned to confront and bear against said cross-frame member vertical leg portion, said upper portion being inclined inwardly and downwardly at an acute angle of at least 20 degrees relative to said cross-frame member, said first leg member further defining a lower portion which is vertically disposed and which is integrally formed with said upper portion, said lower portion being disposed to mount said floor engaging means and to support said bed frame on a floor, said second leg member being generally rectilinear in cross-section and defining side wall members parallel with the side walls of said first leg member, said second leg member being slidably and telescopically received entirely within the upper portion of an associated first leg member, said second leg member having ear means positioned to confront and engage said side-frame member horizontal leg portion, said horizontal leg portion and said ear means each defining aligned apertures for receiving mechanical fasteners, said second leg member defining recess means in said second leg side wall members for accommodating said mechanical fasteners in said cross frame members, said second leg member being inclined inwardly and downwardly at an acute angle substantially equal to the angle at which the associated first leg member upper portion is inclined, and wherein, when said first leg members are telescopically disposed relative to said associated second leg members, the side-frame and cross-frame members are secured to each other to form said bed frame and said leg member lower portions and associated floor engaging means are disposed inset of said side-frame members.

2. A bed frame as set forth in claim 1, and wherein aaid recess means in said side wall members extend upwardly from the lower edge thereof and in alignment with mechanical fasteners in said cross frame members.

3. A bed frame as set forth in claim 1, and wherein said second leg member has a back connecting said side wall members of said second leg member and wherein each said side wall member of said second leg member includes a projecting front segment parallel to said back.

4. A bed frame comprising a pair of spaced longitudinally extending parallel side-frame members, each said side-frame member having a horizontal leg portion, a pair of spaced parallel cross-frame members extending between said side-frame members, each said cross-frame member having a vertical leg portion, means for securing said side-frame members to the ends of said cross-frame members and for supporting said frame on a floor, said securing and supporting means including a plurality of first and second leg members, and floor engaging means, a pair of said first leg members being secured to each of said cross-frame members, and a pair of said second leg members being secured to each of said side-frame members and telescopically disposed within said first leg members, each said first leg member including an upper portion which is generally rectilinear in cross-section and which defines an upper end which is generally coplanar with the upper edge of said cross-frame member vertical leg portion, said upper portion having a generally C-shaped channel configuration defining an interior receiving region for receiving one of said second leg member, said upper portion comprising a back and opposed spaced side walls, each said side wall including a projecting front segment parallel to the back, each said first leg member being secured to one of said cross-frame members with a said side wall of said first leg member being positioned to confront and bear against said cross-frame member vertical leg portion, said upper portion being inclined inwardly and downwardly at an acute angle of at least 20 degrees relative to said cross-frame member, said first leg member further defining a lower portion which includes a vertically disposed part that is integrally formed with said upper portion, said lower portion being disposed to mount said floor engaging means and to support said bed frame on a floor, said second leg member being generally rectilinear in cross-section, said second leg member having a generally C-shaped channel configuration and comprising a back and opposed side wall members, at least one of said side wall members of said second leg member defining a recess adjacent one of said side walls of said first leg member, each said side wall member of said second leg member including a projecting front segment parallel to said back of said second leg member, said second leg member being positioned to confront and engage said side-frame member horizontal leg portion, said second leg member being inclined inwardly and downwardly at an acute angle substantially equal to the angle at which the associated first leg member upper portion is inclined, and wherein, when said first leg members are telescopically disposed relative to said associated second leg members, said projecting front segments of said second leg members are disposed adjacent said projecting front segments of said first leg members, the side-frame and cross-frame members are secured to each other to form said bed frame; and said first leg member lower portions and associated floor engaging means are disposed inset of said side-frame members.

5. A bed frame as set forth in claim 4, and wherein said second leg member projecting front segments define an elongate slot between them, and wherein said first leg member projecting front segments define an elongate slot between them, and wherein said leg members are oriented with said backs facing the outside of said frame and said elongate slots facing the inside of said frame.

6. A bed frame as set forth in claim 4, and wherein said lower portion of said first leg member is generally rectilinear in cross-section.

7. A bed frame as set forth in claim 4, and wherein said first leg member is secured to said cross-frame member with mechanical fasteners.

8. A bed frame as set forth in claim 4, and wherein said second leg member is secured to said side frame member with mechanical fasteners.

* * * * *

UNITED STATES PATENT AND TRADEMARK OFFICE

CERTIFICATE OF CORRECTION

PATENT NO. : 4,627,120

DATED : December 9, 1986

INVENTOR(S) : George M. Harris

It is certified that error appears in the above-identified patent and that said Letters Patent is hereby corrected as shown below:

Column 7, after line 52 and before line 53, insert the following paragraph:

--a pair of first said leg members being mechanically secured to each of said cross-frame members, and--.

Signed and Sealed this

Thirteenth Day of October, 1987

*Attest:*

DONALD J. QUIGG

*Attesting Officer*

*Commissioner of Patents and Trademarks*